United States Patent [19]

Nelson

[11] Patent Number: 4,776,055

[45] Date of Patent: Oct. 11, 1988

[54] DENTAL INSTRUMENT

[76] Inventor: Stanley E. Nelson, New York, N.Y.

[21] Appl. No.: 17,139

[22] Filed: Feb. 20, 1987

[51] Int. Cl.[4] ..... A46B 9/04

[52] U.S. Cl. ..... 15/167.1; 15/110; 15/143 R; 15/DIG. 5; 128/62 A

[58] Field of Search ..... 15/167 R, 167 A, 110, 15/DIG. 5, 143 R; 128/62 A

[56] References Cited

U.S. PATENT DOCUMENTS

| | | | |
|---|---|---|---|
| 1,369,966 | 3/1921 | Cosens et al. | 15/167 R |
| 1,639,880 | 8/1927 | Butler | 15/167 R |
| 4,519,111 | 5/1985 | Cavazza | 15/167 R |

FOREIGN PATENT DOCUMENTS

| | | | |
|---|---|---|---|
| 2512256 | 9/1976 | Fed. Rep. of Germany | 15/167 R |

*Primary Examiner*—Peter Feldman
*Attorney, Agent, or Firm*—Kenyon & Kenyon

[57] ABSTRACT

A toothbrush having a pad of bristles, a neck region and a handle is disclosed. The bristle pad has three longitudinally arranged columns of bristles, except at the distal end of the pad where there are two additional columns of bristles. The handle is short, so as to bring the user's hand into a closer relation to the mouth and teeth. The reverse side of the bristle pad has a concavity for receiving the user's finger.

1 Claim, 1 Drawing Sheet

DENTAL INSTRUMENT

BACKGROUND OF THE INVENTION

This invention relates to the field of dental instruments in general and toothbrush-type instruments in particular.

The use of a toothbrush (along with dental floss) has long been the primary in-home technique for the maintenance of oral health. Toothbrushing has several long-standing and well known shortcomings in this regard.

Conventional brush designs are best suited for cleaning only the crown of the tooth. This is completely inadequate to maintain the health of tooth supporting structures, including the gums. It is now known that disease producing microorganisms are harbored in the *sulcus marginalis*, the groove or pocket between the tooth and gums. These microorganisms include the bacteria which cause caries, plaque, tartar and, most importantly gum disease. Regular and thorough cleaning of this region is now known to be essential to good oral health. Conventional toothbrushes are neither designed or suited to clean this area. When used to do so, they achieve poor results resulting in continued gum disease.

In addition to the inability of most conventional toothbrushes to effectively clean around and below the gum line, there are other problems associated with these devices. Conventional brushes are not "user friendly". That is, they are not, by virtue of their design, naturally used in the correct manner. In fact, most toothbrushes are easier to misuse than they are to use correctly. This results in very poor patient compliance with the overall oral hygiene program in general and the tooth and below the gum area cleaning regimen in particular.

It is therefore an object of this invention to provide a new toothbrush which is well suited to the easy and effective cleaning of the entire tooth and gum area, especially the region of the *sulcus marginalis* (no matter its depth) and below to the point of gum attachment. It is also an object of the present invention to provide a new toothbrush which is easy to use in the proper manner and does not lend itself to misuse by those having poor technique.

BRIEF DESCRIPTION OF THE INVENTION

In a toothbrush according to the present invention there is a handle, a pad of bristles and a neck region which joins the pad and handle. The bristle pad has three longitudinal columns of bristles, except at the distal end of the pad where there are two additional columns of bristles. The two additional columns are located on each side of the central column and are medial to each of the lateral columns. The bristle pad is wide enough that all five columns of bristles could be accommodated along its entire length on the region of the pad where there are only three columns, this results in a significant gap between the columns. The handle is short so as to bring the user's hand into a closer relation to the mouth and teeth. On the reverse side of the pad which is free of bristles there is a concavity for receiving the thumb or index finger of the user. The neck of the brush can be rounded outwardly, preferably in an oval shape, to facilitate rotation of the brush.

DETAILED DESCRIPTION OF THE INVENTION

Figure 1:
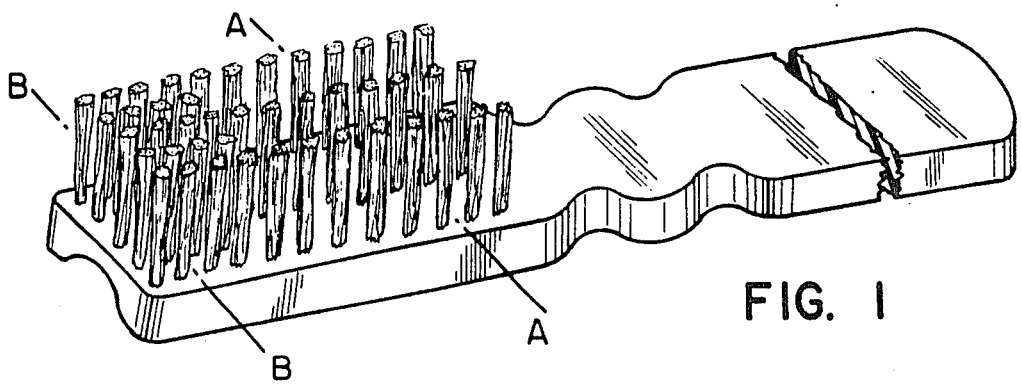
FIG. 1 is a view of a dental instrument according to the present invention.
Figure 2:
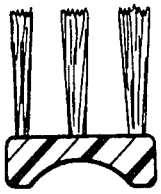
FIG. 2 is a cross sectional view through region "A" of the instrument shown in FIG. 1.
Figure 5:
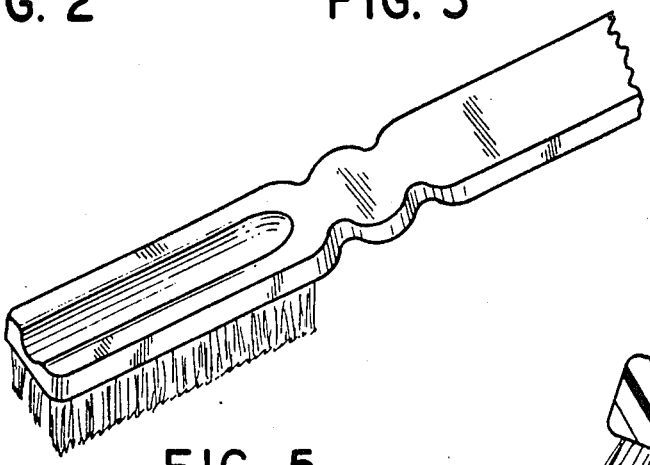
FIG. 5 is a view of the reverse side of the instrument shown in FIG. 1.

A device according to the present invention is shown in FIG. 1. It is preferably 4.5 inches long but may be up to 6.5 inches in length. The dimensions of the bristle pad may be varied to suit the age and size of mouth of the user. For an average adult, the bristle pad should be from 1.25 to 2.0 inches long and from 0.25 to about 0.75 inches wide. Such a pad can be considerably larger than those in conventional brushes. The bristles may be of any material which is conventionally used in toothbrush bristles. Polished nylon or selected natural bristles are preferred. The bristles are preferably about 0.4375 inches long in a brush intended for use by a healthy adult and about 0.75 inches long in a brush intended for use by an adult with diseased gums. A children's brush would typically have bristles that are about 0.25 to 0.4375 inches long. The 5-column, distal portion of the pad should take up about one-eighth to one-fourth of the length of the pad. As shown in FIG. 5, the side of the pad which is opposite the bristles may have a concavity shaped to receive the users thumb or index finger.

The neck region of the device should be fairly short, only about 0.25 to about 0.375 inches long, and should have a generally circular or elliptical cross section. The neck region is advantageously joined to the pad by a short, relatively thin section which further facilitates the manipulation of the device and enhances the user's "tactile sense". The handle section of the device is advantageously shaped to be gripped by the user and the total design of the brush is intended to facilitate the accurate placement of bristles beneath the gums.

In use, the device is gripped by its short handle using the last three fingers while either the index finger or the thumb is placed on the back side of the bristle pad. The choice of whether to place either the index finger or the thumb on the back of the bristle pad will be made on the basis of the area of the mouth to be cleansed. It is to be expected that the device will be shifted in the users hand several times as the instrument is used and that both the thumb and index finger will be used at various times during the procedure. Given the dimensions and arrangement of the present device, the user is required to bring his hand into very a close functional relation to the teeth and gums. Indeed, it will be necessary to introduce at least one finger directly into the mouth. This enhances tactile feedback and has a favorable effect on the ability of the user to easily cleanse the teeth and remove plaque beneath the gums by the appropriate placement, motion and application of pressure with the brush.

Figure 6:
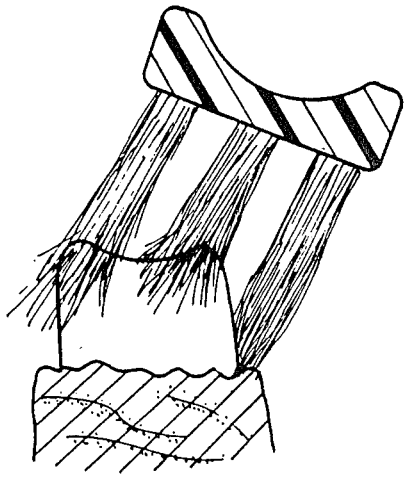
FIG. 6 is a view of the device of the present invention in use.

As can be seen in FIG. 6, when the bristle pad of the device is brought into contact with the teeth the design of the device causes it to be used in the proper manner. Note that the central column of bristles acts not only to cleanse the occlusal surface but also serves to remove plaque (and other material) from the interproximal spaces and to guide the placement of the brush so that the lateral column extends along the side of the tooth to below the gum line and the *sulcus marginalis* to the point of attachment of the gums to the teeth. This design makes it unlikely that anyone but the most obstinate and intentional misuser will fail to cleanse the crown, *sulcus marginalis* and beneath the gums.

Figure 3:
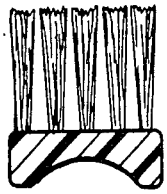
FIG. 3 is a cross sectional view through region "B" of the instrument shown in FIG. 1.

The distal end of the bristle pad, which is shown in cross section in FIG. 3, is configured to cleanse the rearmost and interproximal surfaces of the teeth. In use, the brush is applied over the top and side molars to reach and cleanse the interproximal surfaces and the rearmost surface.

Figure 4:
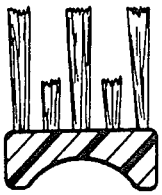
FIG. 4 is a cross sectional view through region "A" of an alternate embodiment of the instrument shown in FIG. 1.

In an optional embodiment of the present invention, such as is shown in FIG. 4, the two additional columns of bristles may extend the full length of the bristle pad. However, in this embodiment it is important that in the proximal two-thirds to seven-eighths of the bristle pad (that is to say the region which would otherwise have only three columns of bristles) the two extended columns of bristles must be considerably shorter than the other three columns. Preferably, the two extended columns are at most only about 30 percent as tall as the other columns. This configuration has the advantage of making additional bristles available for cleansing the crown of the tooth, if such should be desired, without interfering with the guiding function of the three taller columns of bristles.

The elements of this instrument, including the brush and handle, combine to form a system which is engineered to *deliver the ends of the bristles to the depths of the sulcus or pocket.* This provides the effective removal of subingival plaque which removal is essential to peridontal disease control.

A great number of variations on the forgoing design principles may be suggested to one in this art upon a reading of the present specification. For example, the handle may include or be fitted with a receptacle for a toothpick or gum stimulator device. It is also within the scope of the present invention to arrange the bristles so that some or all of them project from the brush at medial or longitudinal angles. These embodiments and the other embodiments described in this application are illustrative only and are not intended to limit the scope of the present invention which is defined by the following claims.

I claim:

1. A dental instrument comprising:

a bristle pad, a handle and a neck segment joining the handle, the bristle pad having bristles on only one side thereof, wherein the bristle pad is from about 1.25 to about 2.0 inches long and from about 0.3 to about 0.75 inches wide and the neck segment is from about 0.25 to about 0.375 inches long and the entire instrument is from about 4.0 to about 6.5 inches long and wherein the bristle pad has bristles arranged in two lateral and one central column which columns extend along the full length of the bristle pad, the brisles in said three columns being from about five-sixteenths to about one-half inches long and said columns being spaced about five-sixteenths to about three-sixteenths inches apart and wherein the bristle pad has a proximal and a distal portion, the distal portion comprising about one-eight to about one-fourth of the total length of the bristle pad and being characterized by the presence of two additional columns of bristles which are located lateral to the central column and medial to the lateral column and which are of a length which is approximately equal to that of the central and lateral columns of bristles and wherein the length of the entire instrument is about 4.5 to 5.0 inches long, and wherein said bristle pad has a concave surface on the side of the bristle pad which does not have bristles and wherein said neck segment has an approximately circular or elliptical cross section and wherein the neck region is joined to the pad by a short, relatively thin section, and wherein the proximal portion of the bristle pad is further characterized by the presence of two additional columns of bristles which are located lateral to the central column and medial to the lateral columns of bristles and wherein said additional columns are at most 30 percent as tall as the central and lateral columns.

* * * * *